US005577294A

United States Patent [19]

Pollock

[11] Patent Number: 5,577,294

[45] Date of Patent: Nov. 26, 1996

[54] WEB CLEANER APPARATUS AND METHOD

[75] Inventor: Rodney E. Pollock, Camas, Wash.

[73] Assignee: James River Paper Company, Inc., Richmond, Va.

[21] Appl. No.: 506,581

[22] Filed: Jul. 25, 1995

Related U.S. Application Data

[62] Division of Ser. No. 130,460, Oct. 1, 1993, Pat. No. 5,466, 298.

[51] Int. Cl.[6] ..... B08B 5/02

[52] U.S. Cl. ..... 15/345; 15/309.1; 15/409; 34/641; 226/97

[58] Field of Search ..... 15/345, 306.1, 15/309.1; 34/641; 226/97

[56] References Cited

U.S. PATENT DOCUMENTS

| | | | |
|---|---|---|---|
| 2,515,223 | 7/1950 | Hollick | 69/1 |
| 3,078,496 | 2/1963 | Doran et al. | 15/346 |
| 3,420,710 | 1/1969 | Wollman | 134/1 |
| 3,436,265 | 4/1969 | Gardner | 134/37 |
| 3,495,932 | 2/1970 | Tuma | 15/345 X |
| 3,587,177 | 6/1971 | Overly et al. | 34/641 |
| 3,629,952 | 12/1971 | Overly et al. | 34/641 |
| 3,650,043 | 3/1972 | Overly et al. | 34/641 |
| 3,775,806 | 12/1973 | Olbrant et al. | 15/309.1 |
| 4,247,993 | 2/1981 | Lindstrom | 34/641 |
| 4,594,748 | 6/1986 | Warfvinge | 15/308 |
| 4,643,775 | 2/1987 | Reba et al. | 134/15 |
| 4,905,500 | 3/1990 | Mason | 15/345 X |
| 4,932,140 | 6/1990 | Lepisto | 34/641 |
| 5,304,254 | 4/1994 | Chino et al. | 134/37 |
| 5,381,589 | 1/1995 | Kotitschke et al. | 15/345 X |
| 5,490,300 | 2/1996 | Horn | 15/345 X |

*Primary Examiner*—Chris K. Moore
*Attorney, Agent, or Firm*—Thomas R. Lampe

[57] ABSTRACT

An apparatus and method for cleaning a moving web of sheet material. The apparatus includes a Coanda nozzle having an elongated, curved foil and a slit for directing gas at a high rate of speed along the foil. The gas from the foil impacts a layer of air entrained by the web of sheet material flowing in an opposed direction. Impact occurs within a gap formed between the foil and the web which becomes increasingly restricted in the direction of movement of the web. The entrained layer of air is caused to reverse direction within the gap and is mixed with the gas from the nozzle under turbulent conditions to clean the web and remove particulate material such as dust therefrom.

4 Claims, 2 Drawing Sheets

WEB CLEANER APPARATUS AND METHOD

This is a division of application Ser. No. 08/130,460 filed Oct. 1, 1993, now U.S. Pat. No. 5,466,298, issued Nov. 14, 1995.

TECHNICAL FIELD

This invention relates to a system for cleaning webs of sheet material. More particularly, the apparatus and method of the present invention have application to removing dust and other particulate matter in an entrained boundary layer carried along by fast moving paper or other webs.

BACKGROUND ART

Many arrangements exist in the prior art for cleaning moving webs such as paper webs. Dust and other entrained particles are often carried along by such webs and can present health and safety problems as well as quality control problems.

It will be appreciated that dust and other particles must be quickly and positively removed from fast moving webs such as those found in paper making and paper conversion facilities. The arrangement of the present invention accomplishes this objective in a highly efficient, relatively low cost manner. One of the components of the present system is a Coanda nozzle of specialized construction which is positioned relative to the web in a particular manner which provides a highly turbulent interface between air flow from the nozzle and the entrained layer of air moving with and bordered by the moving web.

While it is known generally to deploy one or more Coanda nozzles along the path of a moving web to treat the web in some manner or direct movement of the web, the arrangement of the present invention incorporates structure and method steps which cooperate in a unique manner to effectively and positively clean even very fast moving webs.

The following United States patents are believed representative of the current state of the art in this field: 4,932,140, issued Jun. 12, 1990, 4,594,748, issued Jun. 17, 1986, 3,650,043, issued Mar. 21, 1972, 3,629,952, issued Dec. 28, 1971, 3,587,177, issued Jun. 28, 1971, 2,515,223, issued Jul. 18, 1950, 3,078,496, issued Feb. 26, 1963, 3,775,806, issued Dec. 4, 1973, and 4,247,993, issued Feb. 3, 1981.

U.S. Pat. No. 3,775,806 discloses apparatus for removing and collecting dust from a traveling sheet or web of material including a blow box having means for impinging jets of clean air against the sheet both in the direction of travel of the sheet and in the opposed direction. A suction box cooperates with the blow box to form suction gaps withdrawing the air after its engagement with the material to remove the dust from the material.

U.S. Pat. No. 3,078,496 discloses web cleaning apparatus for cleaning a running web of material, such as paper, fabric, or plastic. A pressurized flow of air flows through a restricted passageway about a bulbous element and impinges against a moving web. The direction of web travel and the direction of the air flow are virtually identical. The air flow and entrained matter are then drawn into a suction box.

U.S. Pat. No. 4,932,140 discloses a nozzle box having a carrying face placed facing a web. Two nozzle slots blow toward each other with flow converging above the carrying face. The arrangement of this patent is intended for contact-free supporting and treatment, such as drying, heating or cooling, of paper webs and other continuous webs.

U.S. Pat. No 4,594,748, discloses an apparatus for cleaning particles from a web. An air flow is directed against the web through a pressure slit whereupon the air flow in deflected and guided along the web to two suction slits. The air flow is directed against the web by means of a nozzle in the shape of two expanding blades, each ending in an edge. The suction slits are surrounded by two blades and another two blades prevent the inlet of surrounding air.

U.S. Pat. No. 4,247,993 discloses nozzle apparatus for airborne paper web dryers of the non-impingement or under-pressure type including a blow box member defined by top web supporting and bottom wall portions and back and front wall portions. The front and top supporting wall portions are interconnected by a curved guide surface and an upwardly directed nozzle is provide on the front wall portion spaced below the entry edge plane of the guide surface.

U.S. Pat. No. 3,650,043 discloses an air foil web stabilizer constructed with its opposite ends disposed generally at a slight angle to provide a lateral component to the air discharge in the general direction of web movement to thereby remove wrinkles from the web.

U.S. Pat. No. 3,587,177 discloses an arrangement for the treatment of surfaces such as a web of material to be cleaned, dried or stabilized without physical contact with the web. An air foil nozzle is provided from which cleaning, drying or stabilizing gas is discharged tangentially against the web.

U.S. Pat. No. 3,629,952 discloses an air foil nozzle adjacent a moving web to be dried and constructed with a substantially flat planular guide surface trailing the nozzle, facing the web and substantially parallel thereto.

DISCLOSURE OF INVENTION

The apparatus of the present invention is for use in combination with a web of sheet material moving in a predetermined direction along a predetermined path of movement. The web of sheet material has spaced edges and a substantially planar surface bordering a layer of air entrained by the web of sheet material and moving in the predetermined direction.

The apparatus is for cleaning the substantially planar surface and includes a Coanda nozzle comprising an elongated, curved foil and slit defining means defining an elongated, narrow slit with the elongated, curved foil.

The elongated, narrow slit is for receiving a compressed gas and directing the gas at a high rate of speed along the elongated, curved foil from an upstream location on the elongated, curved foil and past an intermediate location on the elongated, curved foil to a downstream location at an end of the elongated, curved foil.

The Coanda nozzle is positioned closely adjacent to the substantially planar surface of a moving web of sheet material with the downstream location of the elongated, curved foil being further from the substantially planar surface than is the elongated, curved foil intermediate location whereby the elongated, curved foil forms a gap with the moving web substantially planar surface which becomes increasingly restricted in the predetermined direction and within which a layer of air entrained by the moving web of sheet material is impacted by gas flowing at a high rate of speed along the curved foil in a direction generally opposed to the predetermined direction, mixed with the gas under turbulent conditions and caused to substantially reverse direction away from the curved foil.

The apparatus additionally comprises an air discharge chute and means for applying a vacuum to the air discharge chute to direct the mixture of gas and entrained air layer to a location away from the Coanda nozzle. The discharge chute includes a curved, discharge plate adjacent to the elongated, curved foil and curving away from the Coanda nozzle.

The curved discharge plate has an elongated entry end located at the Coanda nozzle and extending along the length of the Coanda nozzle. The curved discharge plate elongated entry end is offset from the elongated, curved foil downstream location along the length of the Coanda nozzle and located further away from the substantially planar surface of a moving web when the Coanda nozzle is adjacent thereto than is the elongated, curved foil downstream location to promote turbulence of the gas and entrained air layer in the gap.

The elongated, narrow slit has a substantially uniform width within the range of from about 0.002 inches to about 0.02 inches. The compressed gas has a pressure within the range of from about 2 psig to about 10 psig prior to flowing through the slit. The compressed gas exits the slit at a speed within the range of from about 29,800 fpm to about 66,600 fpm.

Other features, advantages, and objects of the present invention will become apparent with reference to the following description and accompanying drawings.

BEST MODE FOR CARRYING OUT THE INVENTION

Figure 1:
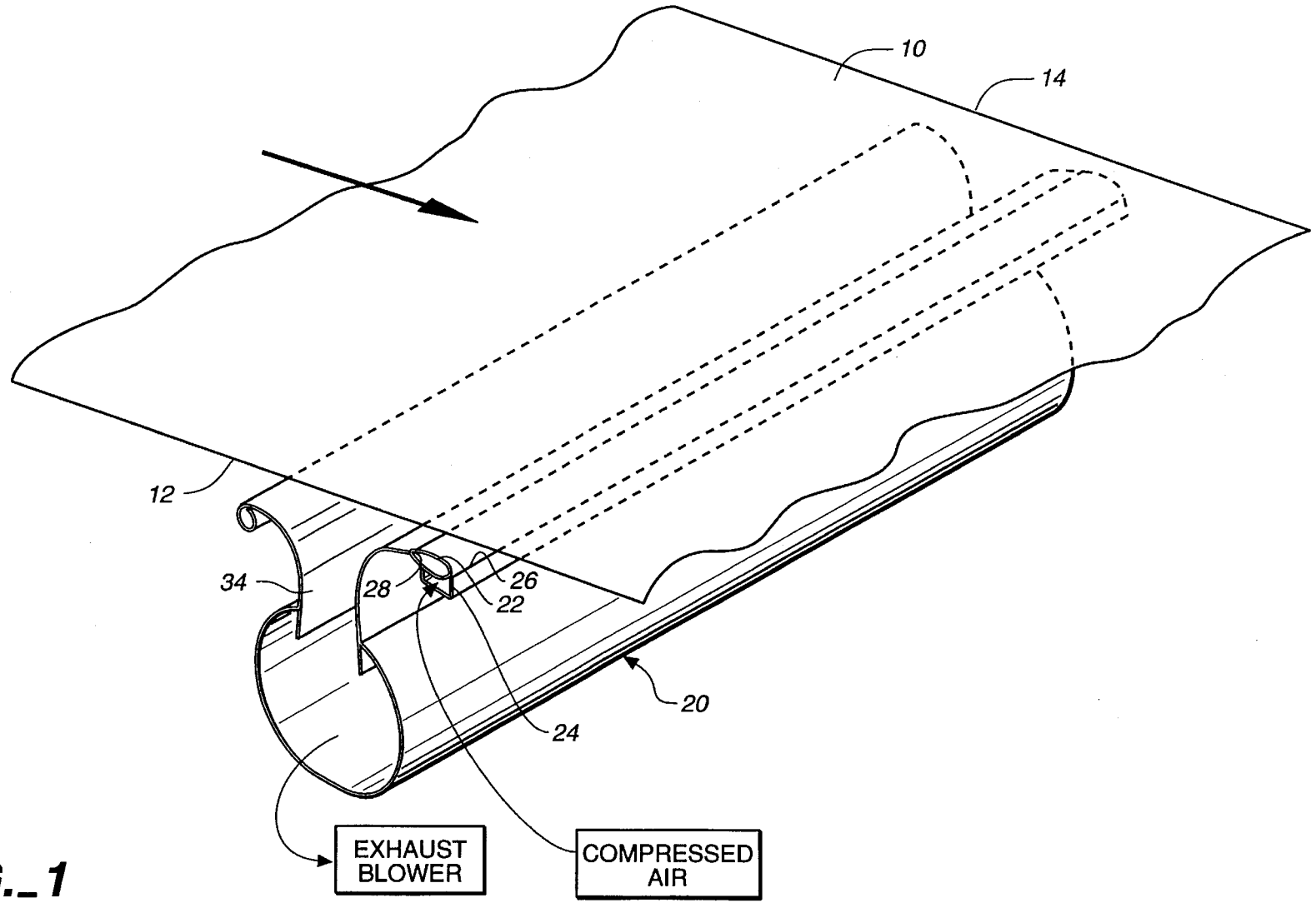
FIG. 1 is a perspective view of apparatus constructed in accordance with the teachings of the present invention in operative association with a moving web.
Figure 2:
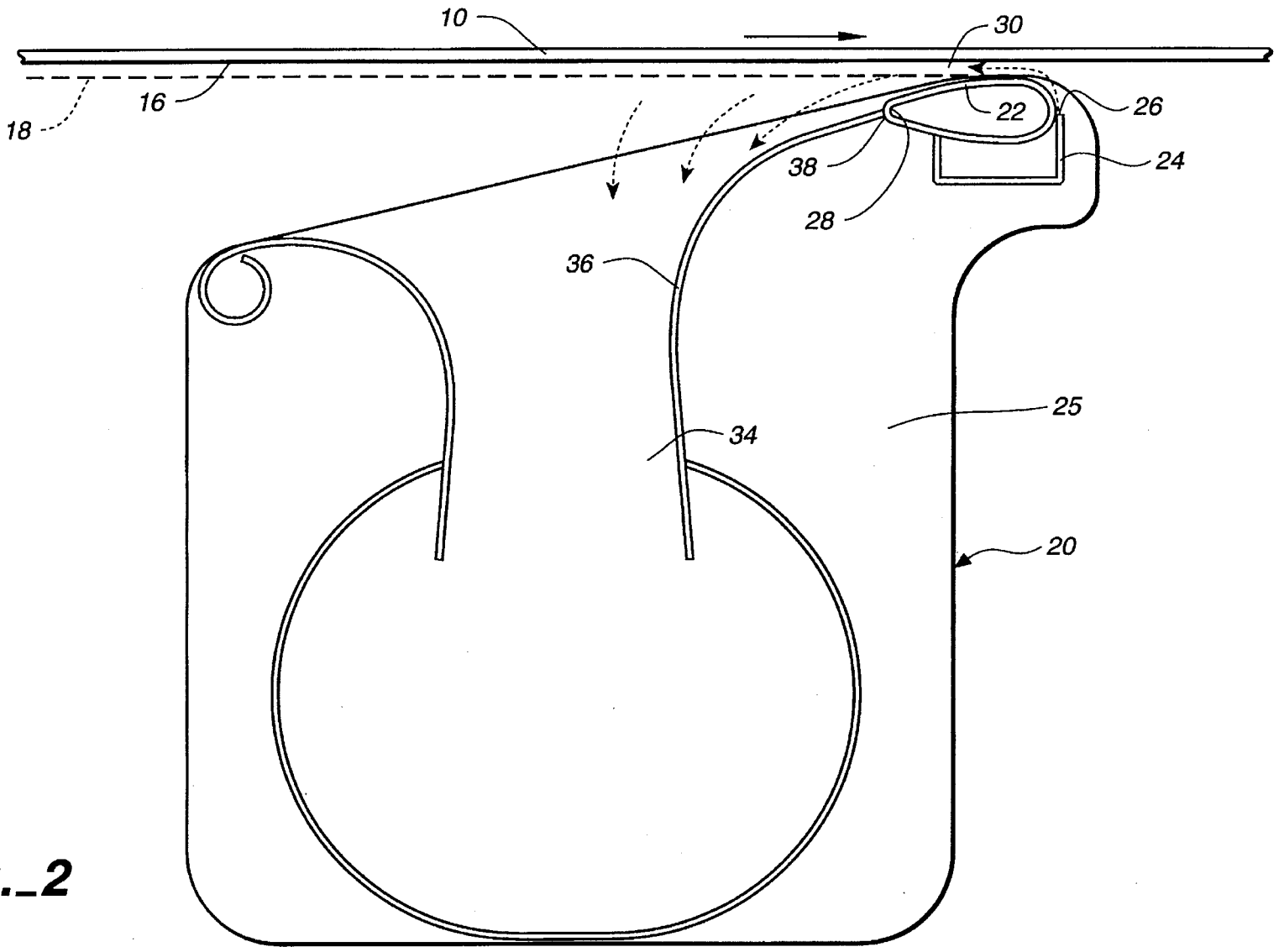
FIG. 2 is a cross-sectional side view of the apparatus disposed under a moving web.

Referring now to the drawings, a web of sheet material, more particularly a paper web 10, is illustrated as moving in a predetermined direction along a predetermined path of movement indicated by the arrow. Web 10 has spaced edges 12, 14 and a substantially planar surface 16 bordering a layer of air 18 (the lower limit of which is denoted by dash lines in FIG. 2) entrained by the web and moving in the same predetermined direction.

It will be appreciated that layer 18 often includes dust and other particulate matter generated during manufacturing or conversion processes. It is the function of the apparatus constructed in accordance with the teachings of the present invention to quickly and efficiently remove such substances from association with the web. Proper cleaning of the web is particularly imperative in those situations wherein the dust or particulate materials represent health or safety problems, as is often the case. For example, dust and other particles, in the absence of proper web treatment, can cause respiratory problems or have the potential for fire or even explosion.

The apparatus 20 of the present invention includes a Coanda nozzle having an elongated, curved foil 22 and a housing 24 defining an elongated, narrow slit 26 with the elongated, curved foil. The interior of housing 24 is connected to a source of pressurized air or other gas.

The pressurized air or other gas exits slit 26 at a high rate of speed, attaching itself to the elongated, curved foil 22 as a result of the Coanda effect. Such gas movement will also serve to entrain ambient air at the location of the Coanda nozzle whereby the gas and ambient air entrained thereby will move from the upstream location on the foil located at the slit and past an intermediate location on the foil closely adjacent to the moving web to a downstream location at the end 28 of the elongated, curved foil.

This will result in impact by the gas and ambient air entrained thereby on the layer of air 18 entrained by web 10. In other words, the flow or direction of movement of air boundary layer 18 will be in opposition to the direction of movement of the gas and entrained ambient air along the foil surface.

It will be noted that the curved foil downstream or end location 28 is further from the substantially planar surface 16 of the web 10 than is the elongated, curved foil intermediate location. Thus, the elongated, curved foil forms a gap 30 with the moving web 10 substantially planar surface which becomes increasingly restricted in the predetermined direction of movement of the web 10. The layer of air entrained by the moving web of sheet material is impacted by the gas and ambient air flowing at a high rate of speed along the curved foil within the gap 30. This results in mixing of the layer of air, gas, and air entrained thereby under turbulent conditions and causes the layer of air 18 to reverse direction away from the curved foil. Since the turbulence adjoins the planar surface 16, a scouring or cleaning action takes place ensuring removal of loose particulate matter from association with the web planar surface.

The apparatus of the present invention also includes an air discharge chute 34 which is utilized to direct the gas and particulate mixture away from the Coanda nozzle to a predetermined location. For example, the mixture may be directed to a filter (not shown) for filtering out the particulates. Preferably, a vacuum is applied to the air discharge chute by an exhaust blower or other suitable vacuum means to ensure transport of the gas-particulate mixture to the desired remote location.

Discharge chute 34 includes a curved, discharge plate 36 adjacent to the elongated, curved foil 22 and curving away from the Coanda nozzle. The curved, discharge plate 36 has an elongated entry end 38 located at the Coanda nozzle and extending along the length of the Coanda nozzle. The curved, discharge plate elongated entry end 38 is offset from the elongated, curved foil downstream location along the length of the Coanda nozzle and located further away from the substantially planar surface of the moving web than is the elongated, curved foil downstream location 28. It has been found that such an arrangement promotes turbulence of the gas, entrained ambient air, and entrained air layer in the gap. In turn, this contributes to the cleaning efficiency of the apparatus.

The Coanda nozzle and air discharge chute extend all the way across the web of sheet material from edge 12 to edge 14. That is, the primary axis of the Coanda nozzle is disposed at substantially right angles to the predetermined direction of the web.

For efficient operation of the apparatus, the elongated, narrow slit 26 has a uniform width within the range of from about 0.002 inches to about 0.02 inches, and even more preferably a width of about 0.01 inch. It is also important that the compressed gas employed for operation of the Coanda nozzle is pressurized within a range of from about 2 psig to about 10 psig prior to flow thereof through the slit. Even more preferably, the compressed gas has a pressure of about 5 psig.

In operation, the gas exits the slit and flows along at least the upstream end of said elongated, curved foil surface at a speed within a range of from about 29,800 fpm to about 66,600 fpm. Operation of the nozzle within such range significantly contributes to the efficiency of the apparatus in cleaning the web and should be compared with prior art devices wherein gas flow speeds and gas pressures are significantly less as well as less effective.

I claim:

1. Apparatus for use in combination with a web of sheet material moving in a predetermined direction along a predetermined path of movement, said web of sheet material having spaced edges and a substantially planar surface bordering a layer of air entrained by said web of sheet material and moving in said predetermined direction, said apparatus for cleaning said substantially planar surface and comprising, in combination:

a Coanda nozzle including an elongated, curved foil and slit defining means defining an elongated, narrow slit with said elongated, curved foil, said elongated, narrow slit for receiving a compressed gas and directing said gas at a high rate of speed along said elongated, curved foil from an upstream location on said elongated, curved foil and past an intermediate location on said elongated, curved foil to a downstream location at an end of said elongated, curved foil, said Coanda nozzle for positioning closely adjacent to the substantially planar surface of a moving web of sheet material with the downstream location on said elongated, curved foil being further from the substantially planar surface than is the elongated, curved foil intermediate location whereby said elongated, curved foil forms a gap with said moving web substantially planar surface which becomes increasingly restricted in the predetermined direction and within which a layer of air entrained by said moving web of sheet material is impacted by gas flowing at a high rate of speed along said curved foil in a direction generally opposed to said predetermined direction, mixed with said gas under turbulent conditions, and caused to substantially reverse direction away from said curved foil; and an air discharge chute and means for applying a vacuum to said air discharge chute to direct the mixture of gas and entrained air layer to a location away from said Coanda nozzle, said discharge chute including a curved discharge plate adjacent to said elongated, curved foil and curving away from said Coanda nozzle.

2. The apparatus according to claim 1 wherein said Coanda nozzle has a primary axis at least about equal to the distance between the spaced edges of said web of sheet material, said Coanda nozzle having the primary axis thereof disposed at substantially right angles to said predetermined direction when said Coanda nozzle is positioned closely adjacent to the substantially planar surface of a moving web of sheet material whereby said Coanda nozzle extends between the spaced edges of said moving web and across substantially the full width of said web.

3. The apparatus according to claim 1 wherein said curved discharge plate has an elongated entry end located at said Coanda nozzle and extending along the length of said Coanda nozzle, said curved discharge plate elongated entry end being offset from said elongated, curved foil downstream location along the length of said Coanda nozzle and located further away from the substantially planar surface of a moving web when said Coanda nozzle is adjacent thereto than is said elongated, curved foil downstream location to promote turbulence of the gas and entrained air layer in said gap.

4. The apparatus according to claim 1 wherein said elongated, narrow slit has a substantially uniform width within the range of from about 0.002 inches to about 0.02 inches.

* * * * *